US005803516A

United States Patent [19]

Hempel

[11] Patent Number: 5,803,516

[45] Date of Patent: Sep. 8, 1998

[54] LATCH ASSEMBLY

[75] Inventor: Conrad Frederick Hempel, Farmington Hills, Mich.

[73] Assignee: Ford Global Technologies, Inc., Dearborn, Mich.

[21] Appl. No.: 691,083

[22] Filed: Aug. 1, 1996

[51] Int. Cl.[6] ..... E05B 3/00; E05C 3/16

[52] U.S. Cl. ..... 292/336.3; 292/223; 292/DIG. 27; 292/DIG. 65; 292/DIG. 21

[58] Field of Search ..... 292/336.3, DIG. 27, 292/DIG. 23, 223, DIG. 65, DIG. 21, DIG. 62; 180/286; 296/146.4, 146.1, 146.9

[56] References Cited

U.S. PATENT DOCUMENTS

| | | | |
|---|---|---|---|
| 2,213,839 | 9/1940 | Hickman et al. | 292/DIG. 27 X |
| 2,567,294 | 9/1951 | McClintock . | |
| 2,640,720 | 6/1953 | Brown . | |
| 2,723,145 | 11/1955 | Smith | 292/DIG. 27 X |
| 2,985,477 | 5/1961 | Priestman et al. | 292/336.3 |
| 2,998,992 | 9/1961 | Brankovic et al. | 292/336.3 X |
| 3,025,091 | 3/1962 | Peras | 292/336.3 X |
| 3,501,189 | 3/1970 | Vik . | |
| 3,525,545 | 8/1970 | Leslie | 292/336.3 X |
| 3,679,251 | 7/1972 | Brockman et al. | 292/DIG. 27 X |
| 4,492,395 | 1/1985 | Yamada | 292/DIG. 27 X |
| 4,796,929 | 1/1989 | Gergoe | 292/336.3 X |
| 5,046,769 | 9/1991 | Rimbey et al. . | |
| 5,234,237 | 8/1993 | Gergoe et al. | 292/DIG. 27 X |
| 5,605,363 | 2/1997 | Kapes | 292/DIG. 23 X |

FOREIGN PATENT DOCUMENTS

| | | | |
|---|---|---|---|
| 3537304 A1 | 4/1987 | Germany . | |
| 516788 | 2/1955 | Italy | 292/336.3 |
| 953264 | 3/1964 | United Kingdom | 292/DIG. 27 |

*Primary Examiner*—Rodney M. Lindsey
*Attorney, Agent, or Firm*—Daniel M. Stock

[57] ABSTRACT

A latch assembly for the rear auxiliary door (18) of a pickup truck (10) includes a latch mechanism (34) having a lost motion mechanism (48, 76, 44, 60, 62, 58) which permits or prevents transmission of unlatching movement between a release handle (40) and a release lever (82).

8 Claims, 5 Drawing Sheets

LATCH ASSEMBLY

BACKGROUND OF THE INVENTION

1. Technical Field

The present invention relates to automotive vehicle latches, and more specifically to mechanisms for selectively disabling the operation of such latches.

2. Description of Related Art

With increasing inclusion in automotive design of auxiliary rear doors in pickup trucks, it has been considered desirable to provide for use of these doors not for universal ingress and egress, but for access during passenger cargo loading of the vehicle into the rear seat portion only when the primary door is open.

While it is known to provide a mechanism that provides for disabling rear door locks through closing operation of the front door of a vehicle (U.S. Pat. No. 3,501,189 to Vik is exemplary of such devices), no such assemblies have been found to be suitable for use with modern rotary door latching mechanisms, nor have they been adapted for use in compact packaging in which the latching mechanism of the rear door is positioned adjacent or proximate the forward face of that door.

SUMMARY OF THE INVENTION

Responsive to the deficiencies in the prior art, the latch disabling assembly of the present invention provides an assembly that includes a latch release lever pivotally mounted on the auxiliary rear door for movement between latching and releasing positions, a release handle pivotally mounted on the rear door for movement corresponding to the latching and releasing positions of the latch release lever, linkage means pivotally mounted on the rear door transmitting movement between the latch release lever and release handle and a lost motion mechanism advantageously carried in compact relationship with the release handle for preventing unlatching movement of the latch release lever when the front and rear doors are in their mutually closed positions.

BRIEF DESCRIPTION OF THE DRAWINGS

Other advantages and features of the latch assembly of the present invention will be apparent to those skilled in the automotive vehicle lock hardware arts upon reading the following description with reference to the accompanying drawings, in which:

FIG. 3 is an enlarged view of a portion of the latch assembly in the position of FIG. 2;

FIG. 8 is an enlarged view of the lost motion connection of the latch disabling assembly of the present invention.

DESCRIPTION OF THE PREFERRED EMBODIMENTS

Figure 1:
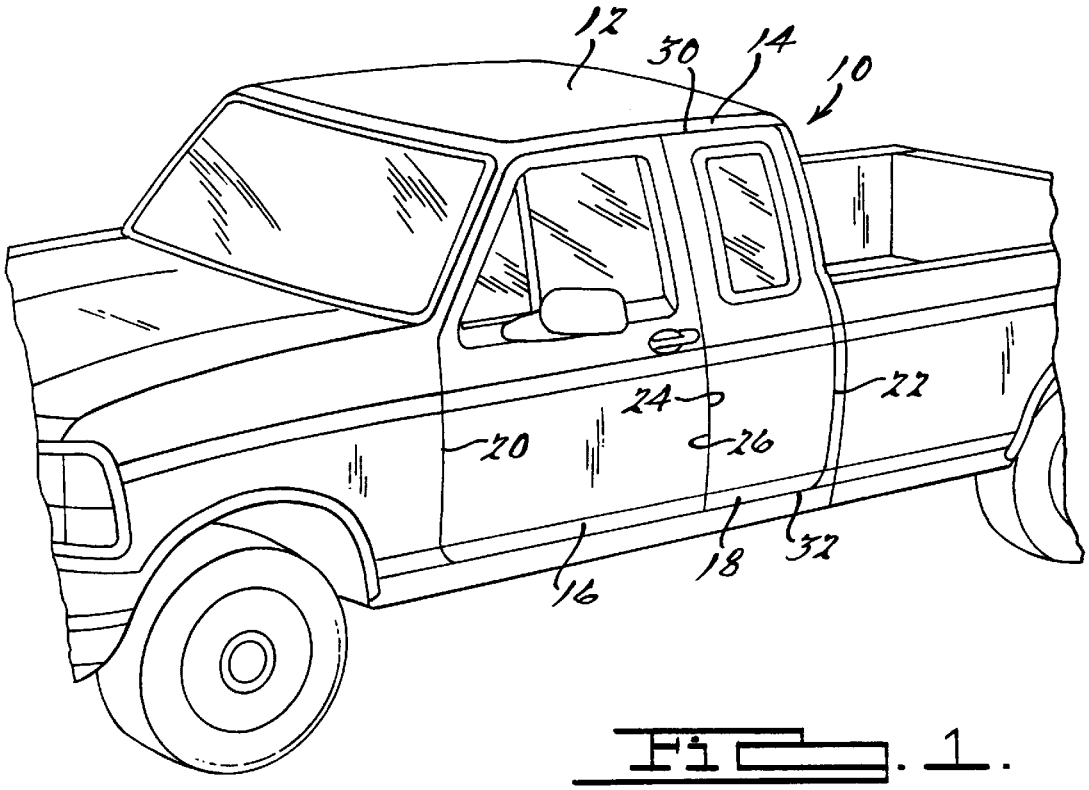
FIG. 1 is a perspective view of a pickup truck illustrating a door arrangement of the type used with the latch assembly of the present invention.
Figure 4:
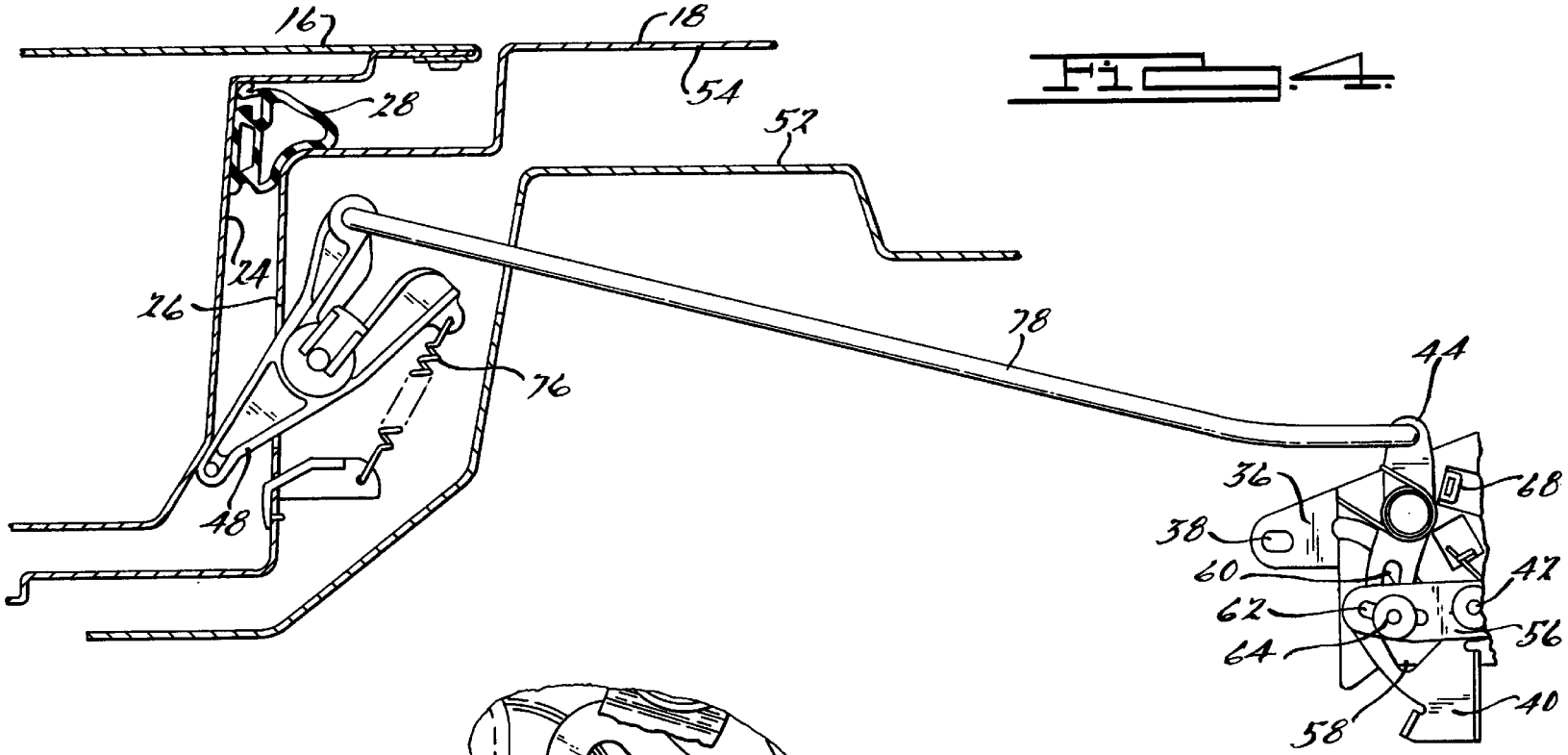
FIG. 4 is a diagrammatic view similar to FIG. 2 in the latch disabled position.

Turning now to the drawings, particularly FIG. 1 thereof, an automotive vehicle 10 is illustrated as including a body 12 having a side 14 selectively closable by a front door 16 and a rear door 18. The front door 16 is preferably hingedly mounted in known manner for pivotal movement about its front edge 20 and the rear door 18 is hingedly mounted for pivotal movement about its rear edge 22. When the doors 16, 18 are in closed position as shown in FIG. 1, the rear edge 24 of the front door 16 and the front edge 26 of the rear door 18 are conventionally arrayed in close juxtaposition as may best be seen in FIG. 4.

A weather seal 28 is preferably mounted on the rear face 24 of the front door 16 for sealing engagement with portions of the rear door 18. The doors 16, 18 are also latched together in a known manner and the rear door 18 is releasably latched to the vehicle body 12 through latching mechanisms coacting between a top edge 30 and the bottom edge 32 of the door 18 in a conventional manner which does not itself form part of this invention.

In a vehicle of the type depicted in FIG. 1, the rear door 18 is typically an auxiliary door, which is to be operated only when the front door 16 is in an open position. To secure the door 18 against latchable release when the front door 16 is in the closed position, a latch assembly, indicated generally at 34, is provided. The latch assembly 34 is illustrated as including a latch housing 36 secured as by fasteners extending through apertures, as indicated at 38, to door 18. The latch housing 36 carries an interior latch release handle 40 pivotally mounted, as by a pin, indicated at 42, to the housing 36 for movement in the counterclockwise direction, as shown in FIG. 2, to effect latch release movement in the manner to be more fully described with respect to the description of FIGS. 6 and 7.

The latch assembly 34 also includes a lockout lever 44 pivotally mounted as by, a pin 46 on the housing 36. Its movement about the pin 46 is effected by an operating lever 48 pivotally mounted as by a pin 50 to the door 18 between an inner panel 52 and an outer panel 54 of the door 18. An intermediate lever 56 is also mounted for pivotal movement about the pin 42 on the latch housing 36 and overlies the release handle 40 which in turn overlies the lockout lever 44. A window 58 is formed in the release handle 40 and arcuate slots 60, 62 are formed in the lockout lever 44 and the intermediate lever 56, respectively. A floating pin 64 extends through the slots 60, 62 for sliding engagement with respect to each and through the window 58 to control movement between the release handle 40 and the intermediate lever 56 through which unlatching movement is transmitted or prevented.

Figure 2:
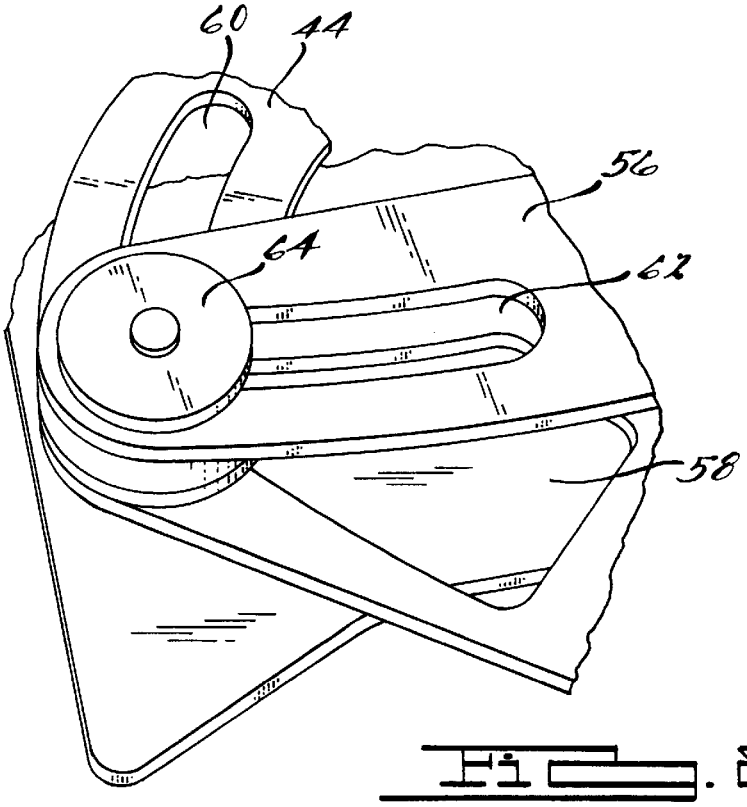
FIG. 2 is a diagrammatic view of the latch system according to the present invention shown in a position in which unlatching movement is permitted.

As may best be seen in FIGS. 2 and 3, when the front door 16 is in the open position, the lockout lever 48 is urged by a spring 76 clockwise against a stop 68 to position the floating pin 64 hard against a driving surface 70 of the release handle 40. Clockwise movement of the release handle 40 accordingly operates to rotate the intermediate lever 56 clockwise about the pin 42.

Figure 5:
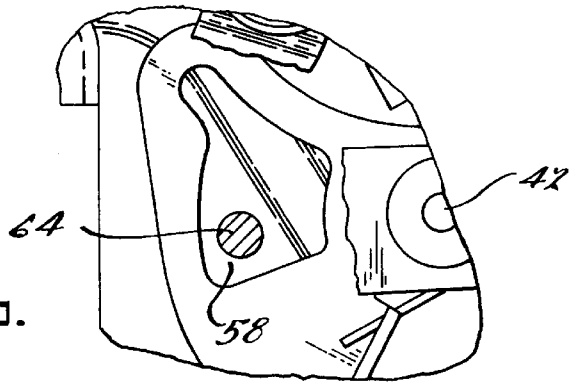
FIG. 5 is a view similar to FIG. 3 in the position of FIG. 4.

It will be noted that the operating lever 48 includes a finger portion 72, which projects outwardly through aperture 74 in the rear door outer panel 54 beyond the front face 26 of the rear door 18. When the front door 16 is moved to the closed position, shown in FIGS. 4 and 5, the operating lever 48 is moved counterclockwise against the influence of a spring 76 that is grounded to the door outer panel 54 of the rear door 18. This motion draws the lockout lever 44 counterclockwise through an operating rod 78 and positions the floating pin 64 generally centrally of the window 58 in the release handle 40, so that clockwise unlatching movement of the release handle 40 is ineffective to transmit unlatching movement to the intermediate lever 56.

Figures 2, 7:
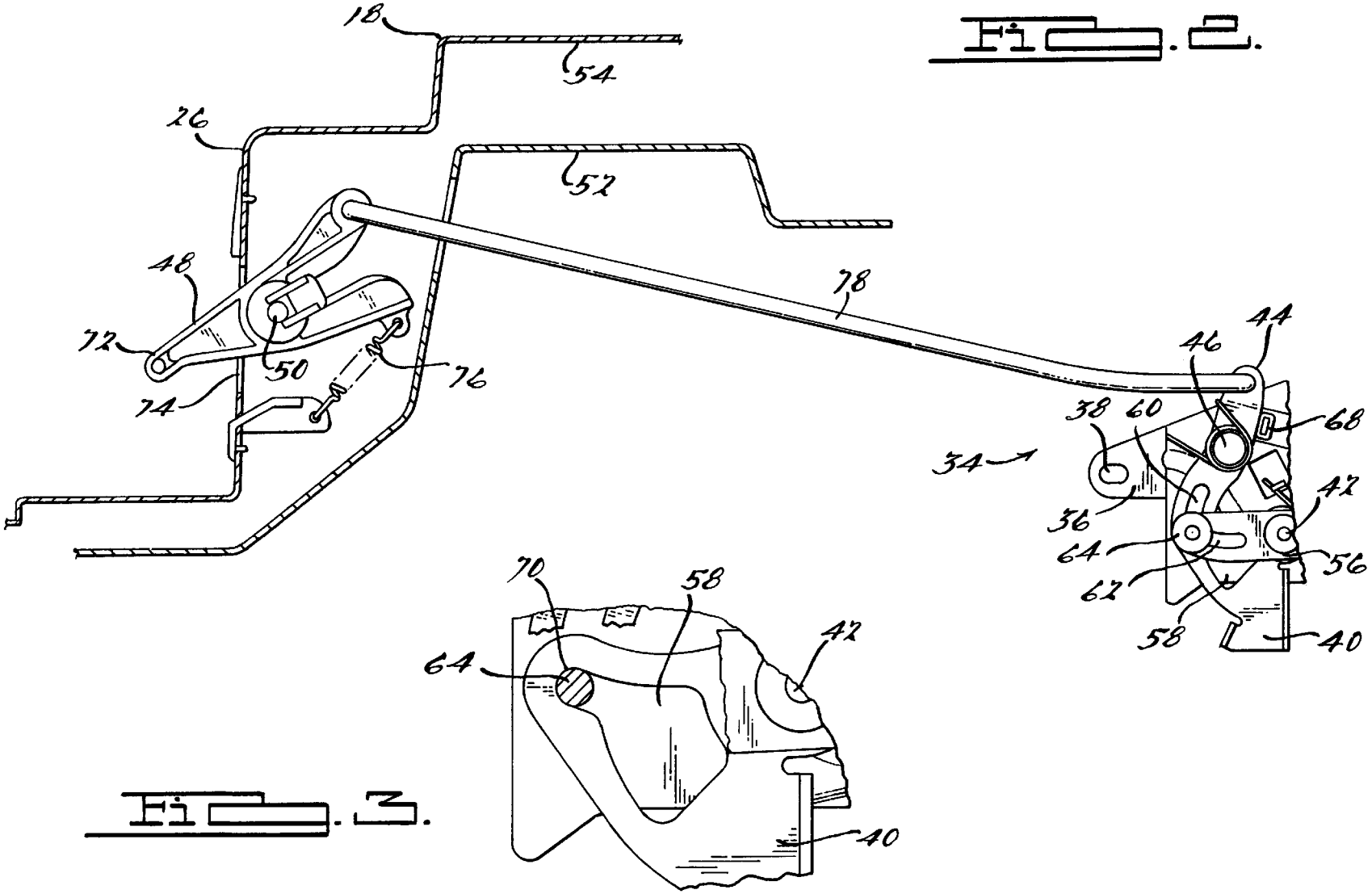
FIG. 7 is a side view of the latch assembly of the present invention in the position permitting unlatching movement.
Figure 6:
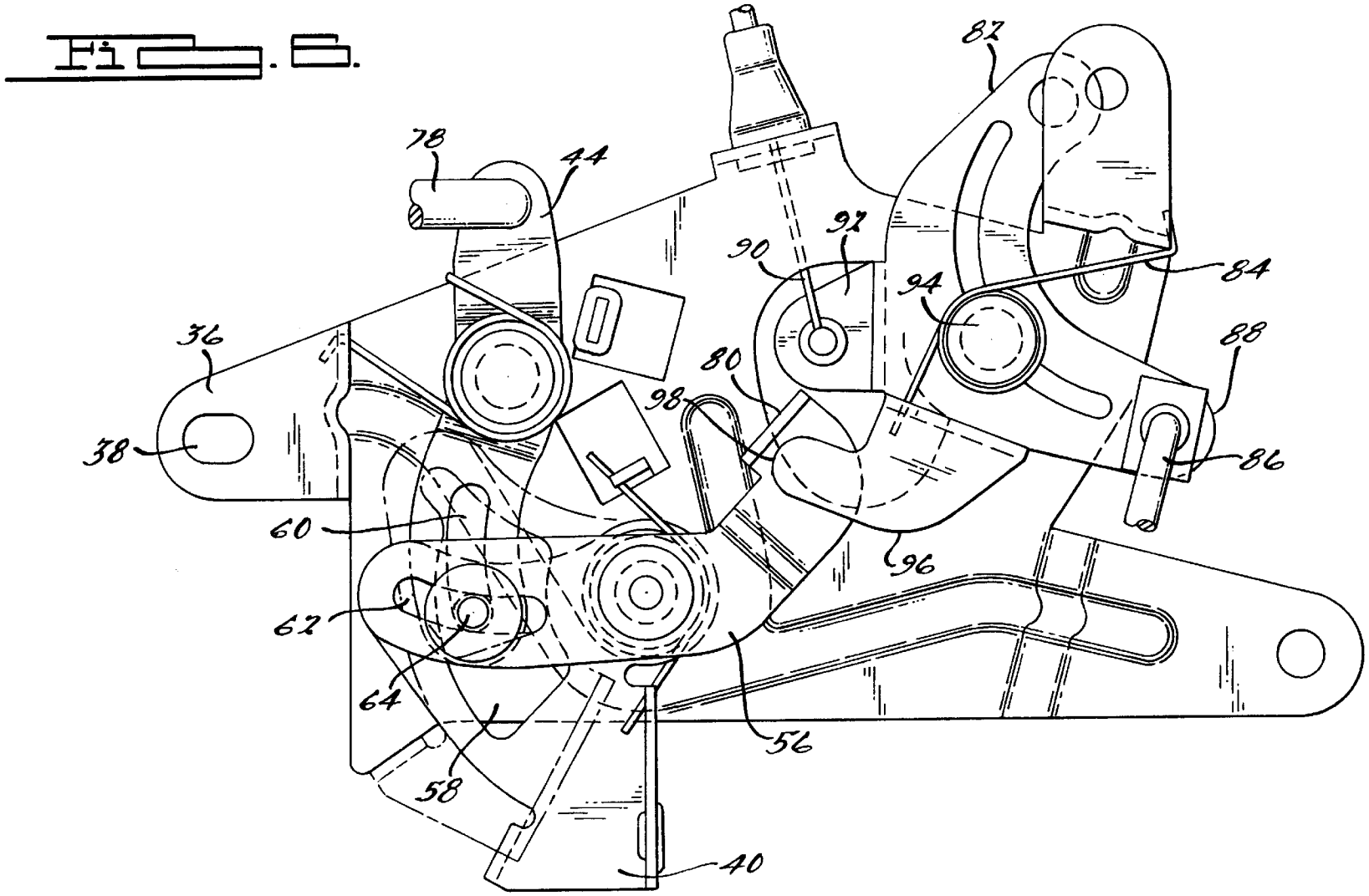
FIG. 6 is a side view of the latch assembly of the present invention in the latch disabling position.
Figure 7:
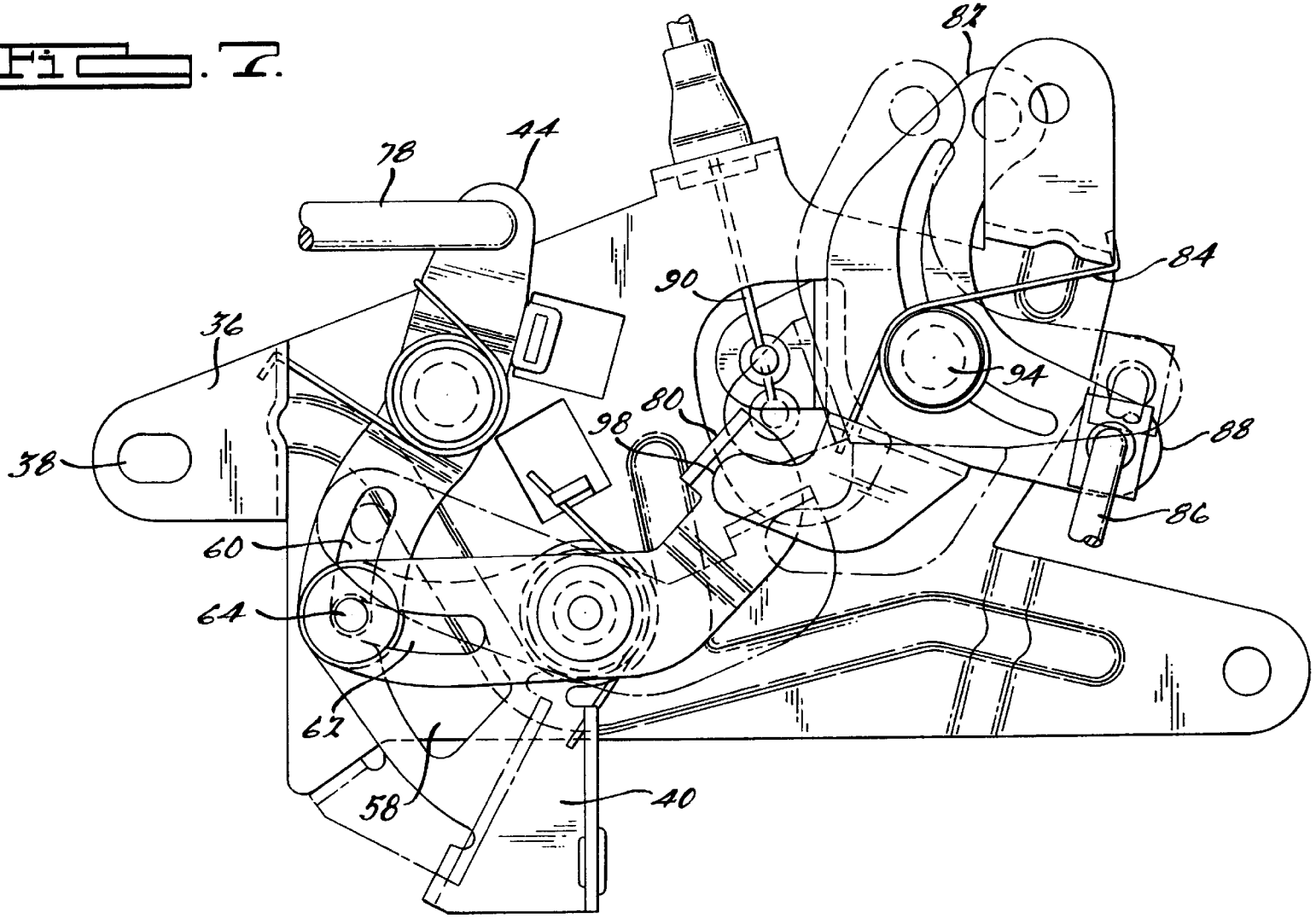

Turning now to FIGS. 6 and 7, according to one preferred embodiment of the latch assembly of the present invention, the intermediate lever 56 includes an upturned abutment portion 80, which is drivingly engageable with a latch release lever 82. The latch release lever 82 is spring-loaded through a spring 84 toward the position shown in FIG. 6, and includes a lower latch actuating rod 86 mounted on an ear 88 and an upper latch operating cable 90 mounted on a second operating ear 92. The latch release lever 82, is pivotally mounted as by a pin 94 to the latch housing 36. An actuating hook 96 depends from the latch release lever 82 and has a nose portion 98 arranged in facing relationship with the abutting portion 80 of the intermediate lever 56. As may best be seen in FIG. 7, clockwise movement of the release handle 40 is transmitted through the floating pin 64 to rotate the intermediate lever 56 in clockwise direction and to pivot the latch release lever 82 in counterclockwise direction, thereby drawing down the upper release cable 90 and drawing up the lower release rod 86 when the floating pin 64 is positioned for abutment with the surface 70 of the release handle 40. When the floating pin 64 is not so positioned, movement of the release handle 40 is not transmitted.

Only certain embodiments of the latch assembly of the present invention has been described. Those skilled in the automotive closure arts will appreciate that others may be possible without departing from the scope of the following claims.

I claim:

1. A latch disabling assembly for a rear door of a vehicle having a front face positioned in juxtaposition with a rear face of a front door of the vehicle when the front door is moved into a closed position with respect to the vehicle, the latch disabling assembly comprising:

a latch release lever for being pivotally mounted on a rear door for movement between the latching and a releasing position;

a release handle for being pivotally mounted on the rear door for movement between a first position corresponding to said latching position, and a second position corresponding to said latch releasing position;

linkage means for being pivotally mounted on the rear door for effecting movement between said release handle and said latch release lever;

a lost motion mechanism operatively carried between said release handle and said linkage means for selectively preventing transmittal of motion therebetween when the front door and the rear door are both in the closed position; and an operating lever for being pivotally mounted on the rear door and operatively connected to the lost motion mechanism, and having a finger portion for projecting forwardly from the front face of the rear door and engaging the rear face of the front door as the front and rear doors move from open to closed position with respect to each other to operate said lost motion mechanism to selectively operate such lost motion mechanism to prevent said transmittal of motion.

2. A latch disabling assembly as defined in claim 1, wherein said lost motion mechanism comprises an intermediate linkage selectively engageable between said latch release lever and the release handle.

3. A latch disabling assembly as defined in claim 2, wherein said lost motion mechanism further comprises a floating pin mounted for relative sliding movement with respect to said intermediate linkage and said release handle.

4. A latch disabling assembly as defined in claim 3, wherein said lost motion mechanism further comprises a lockout lever for being pivotally mounted on said rear door and receiving said floating pin for sliding movement with respect thereto between a first position transmitting movement between said release handle and said latch release lever, and a second position not transmitting such movement.

5. A latch disabling assembly as defined in claim 4, wherein said lockout lever and said intermediate lever each have an arcuately extending slot formed therein for closely slidingly receiving and guiding the motion of said floating pin.

6. A latch disabling assembly as defined in claim 5, wherein said release handle includes a window or receiving said floating pin.

7. A latch disabling assembly as defined in claim 6, wherein said release handle is sandwiched between said lockout lever and said release handle.

8. A latch disabling assembly for a rear door of a vehicle having a front face positioned in juxtaposition with a rear face of a front door of the vehicle when the front door is moved into the closed position with respect to the vehicle, the latch disabling assembly comprising:

a latch release lever pivotally mounted on the rear door for movement between a latching and a releasing position;

a release handle pivotally mounted on the rear door for movement between a first position corresponding to said latching position, and a second position corresponding to said latch releasing position;

linkage means pivotally mounted on the rear door for effecting movement between said release handle and said latch release lever;

a lost motion mechanism operatively carried between said release handle and said linkage means for selectively preventing the transmittal of motion therebetween when the front door and the rear door are both in the closed position, further comprising an intermediate linkage selectively engageable between said latch release lever and said release handle;

a floating pin mounted for relative sliding movement with respect to said intermediate linkage and said release handle;

a lockout lever for being pivotally mounted on said rear door and receiving said floating pin for sliding movement with respect thereto between a first position transmitting movement between said release handle and said latch release lever, and a second position not transmitting such movement; and an operating lever for being pivotally mounted on the rear door and operatively connected to said lockout lever and having a finger portion for projecting forwardly from the front face of the rear door and engaging the rear face of the front door as the front and rear doors move from open to closed positions with respect to each other to move said lockout lever between said first and second positions.

* * * * *